US008646713B2

(12) United States Patent
Belotserkovskiy

(10) Patent No.: US 8,646,713 B2
(45) Date of Patent: Feb. 11, 2014

(54) GYRATORY CRUSHER HAVING A SEAL ARRANGEMENT

(75) Inventor: Konstantin Belotserkovskiy, Malmö (SE)

(73) Assignee: Sandvik Intellectual Property AB, Sandviken (SE)

( * ) Notice: Subject to any disclaimer, the term of this patent is extended or adjusted under 35 U.S.C. 154(b) by 184 days.

(21) Appl. No.: 13/168,268

(22) Filed: Jun. 24, 2011

(65) Prior Publication Data

US 2012/0006918 A1 Jan. 12, 2012

(30) Foreign Application Priority Data

Jul. 9, 2010 (SE) ..... 1050770

(51) Int. Cl.
*B02C 15/10* (2006.01)

(52) U.S. Cl.
USPC ..... 241/216; 241/207; 241/208; 241/209; 241/210; 241/211; 241/212; 241/213; 241/214; 241/215; 277/408

(58) Field of Classification Search
USPC ..... 241/207, 208, 209, 210, 211, 212, 213, 241/214, 215, 216; 277/408
See application file for complete search history.

(56) References Cited

U.S. PATENT DOCUMENTS

| | | | | |
|---|---|---|---|---|
| 1,791,584 A | | 2/1931 | Symons | |
| 3,140,834 A | * | 7/1964 | Symons | 241/216 |
| 4,565,378 A | * | 1/1986 | Wehrfritz et al. | 277/304 |
| 4,793,560 A | | 12/1988 | Schrödl | |
| 5,115,991 A | | 5/1992 | Saari | |
| 5,803,382 A | * | 9/1998 | Ganser et al. | 241/214 |
| 5,964,422 A | * | 10/1999 | Ruokonen et al. | 241/216 |
| 5,971,306 A | | 10/1999 | Ganser, IV et al. | |

(Continued)

FOREIGN PATENT DOCUMENTS

| | | |
|---|---|---|
| GB | 688258 | 3/1953 |
| JP | 2004136252 | 5/2004 |
| RU | 2 174 445 | 10/2001 |

OTHER PUBLICATIONS

International Search Report for PCT/SE2011/050609, dated Oct. 12, 2011.

*Primary Examiner* — Dana Ross
*Assistant Examiner* — Homer Boyer
(74) *Attorney, Agent, or Firm* — Morgan, Lewis & Bockius LLP

(57) ABSTRACT

A gyratory crusher, including an outer crushing shell and an inner crushing shell forming between them a crushing chamber, the crushing chamber communicating with a discharge zone that forwards crushed material from the crushing chamber and out of the crusher. The inner crushing shell is supported on a crushing head. The outer crushing shell is supported on a crusher frame. At least one sealing arrangement is between the discharge zone and a working part zone in which at least one bearing for the crushing head to perform a gyratory movement relative to the crusher frame is arranged. The sealing arrangement includes a sealing surface, and a sealing member arranged to seal against the sealing surface and including an inner circumferential flexible sealing lip, an outer circumferential flexible sealing lip and at least one inlet for pressurized fluid to be supplied to an overpressure zone arranged between the inner and outer sealing lips and the sealing surface. One of the sealing member and the sealing surface is arranged in connection to the crushing head, and the other of the sealing member and the sealing surface is arranged in connection to the crusher frame.

18 Claims, 4 Drawing Sheets

(56) References Cited

U.S. PATENT DOCUMENTS 5,980,115 A * 11/1999 Hoeting ..... 384/478
6,446,892 B1 * 9/2002 Fasoli et al. ..... 241/207
6,536,693 B2 * 3/2003 Van Mullem et al. ..... 241/209
6,942,219 B2 * 9/2005 Khonsari et al. ..... 277/360
8,177,236 B2 * 5/2012 Anderberg ..... 277/408
2009/0008489 A1 * 1/2009 Nieminen et al. ..... 241/207

* cited by examiner

GYRATORY CRUSHER HAVING A SEAL ARRANGEMENT

This application claims priority under 35 U.S.C. §119 to Swedish Patent Application No. 1050770-5, filed on Jul. 9, 2010, which is incorporated by reference herein in its entirety.

FIELD OF THE INVENTION

The present invention relates generally to a gyratory crusher including an outer crushing shell and an inner crushing shell forming between them a crushing chamber, the crushing chamber communicating with a discharge zone being arranged for forwarding crushed material from the crushing chamber and out of the crusher, wherein the inner crushing shell is supported on a crushing head, and the outer crushing shell is supported on a crusher frame. The crusher includes at least one sealing arrangement arranged between the discharge zone and a working part zone in which at least one bearing making it possible for the crushing head to perform a gyratory movement relative to the crusher frame is arranged. The present invention further relates to a method of shielding a working part zone of a gyratory crusher.

BACKGROUND OF THE INVENTION

A gyratory crusher may be utilized for efficient crushing of material, such as stone, ore, etc. into smaller sizes. An example of a gyratory crusher can be found in U.S. Pat. No. 1,791,584. In such a crusher, a crushing chamber is formed between an outer crushing shell, which is mounted in a frame, and an inner crushing shell, which is mounted on a gyrating crushing head. Material is crushed between the outer crushing shell and the inner crushing shell and crushed material falls by gravity from the crushing chamber to a discharge zone situated below the crushing chamber. Interior of the discharge zone, below the crushing head, is a working part zone holding among other things axial and radial bearings required for the gyrating motion of the crushing head. It is important that dust or other particles do not enter the working part zone to avoid damage to the bearings and contamination of lubricant contained in the working part zone.

U.S. Pat. No. 1,791,584 discloses so called wiping members shaped and arranged to prevent the access of dust to the working part zone. Two upper wiping members, i.e. two circumferential and concentric flanges, are formed in the lower part of the crushing head, interior of the discharge zone and exterior of the working part zone. Each of the upper wiping members cooperates with a lower wiping member integrated in the lower frame of the gyratory crusher. Thus, the upper wiping members gyrate along with the gyrating motion of the crushing head and the lower wiping members are immovable.

To further prevent the admission of fine particles into the working part zone compressed air is supplied into the space defined between the wiping members to create an overpressure. A spring is used to thrust the inner one of the lower wiping members upwardly to minimize passage of pressurized air from the space between the wiping members to the working part zone. Further, the outer one of the lower wiping members is arranged with a clearance to its cooperating upper wiping member to allow passage of pressurized air from the space between the wiping members to the discharge zone.

An object of the invention to provide a gyratory crusher with improved functions for preventing the access of dust and particles to the working part zone of a gyratory crusher.

Another object of the invention is to provide a method of shielding the working part zone of a gyratory crusher from dust and particles.

SUMMARY OF THE INVENTION

In an embodiment, the invention provides a gyratory crusher, including an outer crushing shell and an inner crushing shell forming between them a crushing chamber, the crushing chamber communicating with a discharge zone that forwards crushed material from the crushing chamber and out of the crusher. The inner crushing shell is supported on a crushing head. The outer crushing shell is supported on a crusher frame. At least one sealing arrangement is between the discharge zone and a working part zone in which at least one bearing for the crushing head to perform a gyratory movement relative to the crusher frame is arranged. The sealing arrangement includes a sealing surface, and a sealing member arranged to seal against the sealing surface and including an inner circumferential flexible sealing lip, an outer circumferential flexible sealing lip and at least one inlet for pressurized fluid to be supplied to an overpressure zone arranged between the inner and outer sealing lips and the sealing surface. One of the sealing member and the sealing surface is arranged in connection to the crushing head, and the other of the sealing member and the sealing surface is arranged in connection to the crusher frame.

Since either the sealing lips or the sealing surface is arranged in connection to the crushing head, the sealing arrangement separates the discharge zone from the working part zone. The flexible sealing lips and the sealing surface provide a close seal. By "flexible" is meant, when used in conjunction with the sealing lips, that the material properties of the sealing lips are such that when the sealing lips are pressed against the sealing surface in use of the crusher the sealing lips are bent and/or compressed by the sealing surface to provide a tight seal. Furthermore, since the sealing lips are flexible, the fluid in the overpressure zone may flow into the discharge zone by forcing the outer sealing lip away from the sealing surface when the overpressure in the overpressure zone, between the sealing lips, is large enough. Hence, the degree of flexibility of the outer sealing lip can, according to one embodiment, be adapted to make the outer sealing lip being bent away from the sealing surface when a desired pressure has been built up inside the overpressure zone. In other words, an overpressure created in the overpressure zone assures a flow out from the overpressure zone thus preventing particles in the discharge zone from being sucked into the overpressure zone, past the seal. Dust and other particles, mainly originating from the crushing chamber and forwarded to the discharge zone, are in this way effectively prevented from entering the working part zone. The pressurized fluid may for instance be pressurized air, water, nitrogen, or any other suitable fluid.

Preferably, at least one of the sealing lips is bent outwardly by the sealing surface. By "outwardly" is meant that at least one sealing lip is bent in a direction away from the central axis of the crusher. It may be advantageous to have both sealing lips being bent outwardly. If the sealing lips were instead bent inwardly, toward the working part zone, there would be a risk that the pressurized fluid supplied to the overpressure zone between the lips could flow into the working part zone. Then, the effect of having a flow out from the overpressure zone into the discharge zone might be lost. Since either the sealing lips or the sealing surface is arranged in connection to the crushing head there will be a relative gyrating movement between the sealing lips and the sealing surface. It is important that the seal between the sealing lips and the sealing surface works properly during the entire operation of the crusher. Accordingly, having the sealing lips bent outwardly minimizes the risk that the sealing lips, during the gyrating movement, are bent inwardly. Moreover, having the inner one of the sealing lips, i.e. the sealing lip which is closest to the center of the crusher, bent outwardly improves the tight fit of the inner sealing lip to the sealing surface. The pressurized fluid supplied into the overpressure zone will force the outwardly bent inner sealing lip towards the sealing surface thereby improving the sealing effect. Depending on for instance the material properties of the flexible sealing lips, and the size of the lips, a large portion of the respective lip may be bent outwards, or only a tip portion of the respective lip may be bent.

According to one embodiment the sealing surface slopes downwardly, as seen in a direction from the discharge zone towards the working part zone. A preferred shape of the sealing surface may be a bulging shape, which may, for example, have the shape of a spherical segment surface. In such an embodiment it may be preferred that both sealing lips are bent outwardly. Since the sealing surface is made of a rigid material the bent portions of the flexible sealing lips, or at least the tip portions of the bent sealing lips, will follow the shape of the sealing surface. Thus, having the sealing surface sloping downwardly will allow the outwardly bent sealing lips to be bent smoothly. It may be preferred that the inner sealing lip is shorter than the outer sealing lip. By "shorter" as used in conjunction with the relation between the inner and outer lips is here meant that the height of the lip, from the portion of the sealing member arranged on the crusher head or crusher frame to the tip of the lip, is lower for the inner lip than for the outer lip.

Preferably, the sealing surface is arranged in connection to the crushing head. The sealing member is then arranged in connection to the crusher frame which is immovable, in contrary to the crushing head which gyrates, when the crusher is in operation. Having the sealing member immovable may facilitate the supply of pressurized fluid between the sealing lips of the sealing member.

According to one embodiment the sealing member comprises a perforated member which holds the sealing lips and allows passage of pressurized fluid from the inlet to the overpressure zone. Thus, the sealing lips are arranged on a common structure which also includes the perforated member. Pressurized fluid may be supplied from the inlet, through perforations or similar openings in the perforated member and into the overpressure zone. Thus, the overpressure zone is defined by the sealing lips, the perforated member and the sealing surface.

In another embodiment, the invention provides a method of shielding a working part zone of a gyratory crusher. The gyratory crusher includes an outer crushing shell and an inner crushing shell forming between them a crushing chamber, the crushing chamber communicating with a discharge zone being that forwards crushed material from the crushing chamber and out of the crusher. The inner crushing shell is supported on a crushing head, and the outer crushing shell is supported on a crusher frame. At least one sealing arrangement includes a sealing member and a sealing surface and is situated between the discharge zone and the working part zone in which at least one bearing for the crushing head to perform a gyratory movement relative to the crusher frame is arranged. The method includes supplying pressurized fluid to an overpressure zone located between an inner circumferential flexible sealing lip and an outer circumferential flexible sealing lip of the sealing member to make the sealing member seal against the sealing surface, one of the sealing member and the sealing surface being arranged in connection to the crushing head, and the other of the sealing member and the sealing surface being arranged in connection to the crusher frame.

An advantage of this method is that the pressurized fluid supplied to the overpressure zone will act together with the flexible sealing lips to provide a seal between the discharge zone and the working part zone. The flexible sealing lips provide a tight seal against the sealing surface. The pressurized fluid assures that an overpressure is kept between the sealing lips, in the overpressure zone. This prevents dust or particles in the discharge zone from penetrating the seal.

Preferably, one or both of the sealing lips are bent outwardly by the sealing surface.

Preferably, the pressurized fluid supplied to the overpressure zone forces the outer sealing lip away from the sealing surface. An advantage of this embodiment is that the fluid supplied to the overpressure zone leaves the overpressure zone in a predictable manner, and in a direction which tends to blow dust, grit etc away from the sealing surface and away from the working part zone.

Preferably, the pressurized fluid supplied to the overpressure zone forces the inner sealing lip against the sealing surface. An advantage of this embodiment is that a very tight seal between the inner sealing lip and the sealing surface is achieved, which further reduces the risk that any dust, grit, etc may enter the working part zone.

BRIEF DESCRIPTION OF THE DRAWINGS

The accompanying drawings, which are incorporated herein and constitute part of this specification, illustrate the presently preferred embodiments of the invention, and together with the general description given above and the detailed description given below, serve to explain features of the invention.

DETAILED DESCRIPTION OF THE PREFERRED EMBODIMENTS

Figure 1:
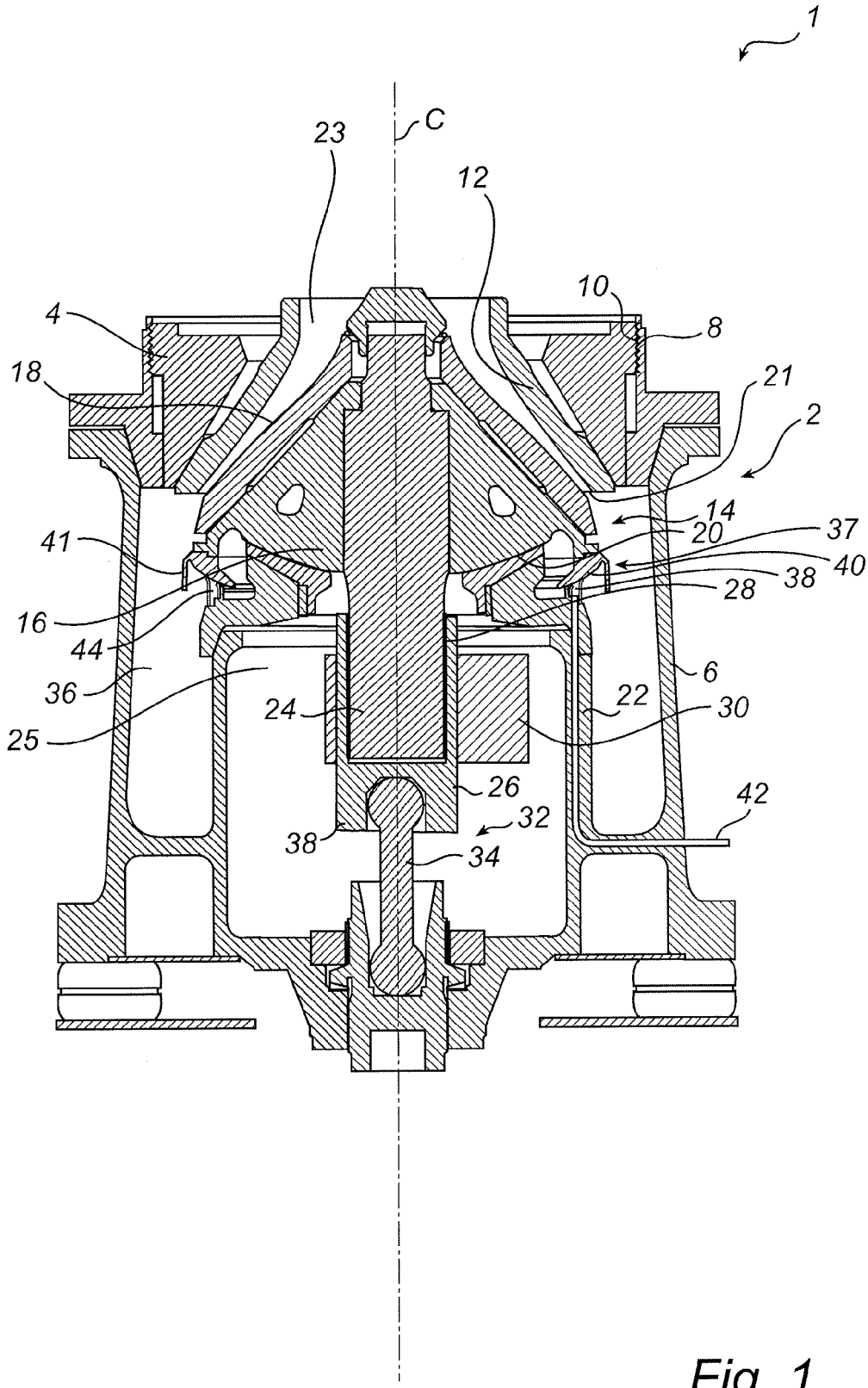
FIG. 1 is a schematic side view, in cross-section, of a gyratory crusher according to an embodiment of the invention.

FIG. 1 illustrates a gyratory crusher 1 in accordance with an embodiment of the present invention. The gyratory crusher 1 includes a crusher frame 2. The crusher frame 2 includes an upper frame portion 4, and a lower frame portion 6. The upper frame portion 4 has the form of a bowl and is provided with an outer thread 8 which co-operates with an inner thread 10 of the lower frame portion 6. The upper frame portion 4 supports, on the inside thereof, an outer crushing shell 12. The outer crushing shell 12 is a wear part which may be made from, for example, a manganese steel.

The lower frame portion 6 supports an inner crushing shell arrangement 14. The inner crushing shell arrangement 14 includes a crushing head 16, which has the form of a cone and which supports an inner crushing shell 18, which is a wear part which may be made from, for example, a manganese steel. The crushing head 16 rests on a spherical bearing 20, which is supported on an inner cylindrical portion 22 of the lower frame portion 6.

The outer and inner crushing shells 12, 18 form between them a crushing chamber 23 to which material that is to be crushed is supplied. A discharge opening 21 of the crushing chamber 23, and thereby the crushing capacity, can be adjusted by turning the upper frame portion 4, by the threads 8,10, such that the distance between the shells 12, 18 is adjusted.

The crushing head 16 is mounted on a crushing shaft 24. At a lower end thereof, in a working part zone 25 of the crusher 1, the crushing shaft 24 is encircled by a cylindrical sleeve 26. The cylindrical sleeve 26 is provided with an inner cylindrical bearing 28 making it possible for the cylindrical sleeve 26 to rotate around the crushing shaft 24. An unbalance weight 30 is mounted on one side of the cylindrical sleeve 26. At its lower end the cylindrical sleeve 26 is connected to a vertical drive shaft 32. The drive shaft 32 includes a ball spindle 34. When the crusher 1 is in operation the drive shaft 32 is rotated by a motor (not shown). The rotation of the drive shaft 32 causes the sleeve 26 to rotate and swing outwards by the unbalance weight 30, displacing the unbalance weight 30 further away from the central axis C of the crusher 1, in response to the centrifugal force to which the unbalance weight 30 is exposed. Such displacement of the unbalance weight 30 and of the cylindrical sleeve 26 to which the unbalance weight 30 is attached is allowed due to the ball spindle 34 and the fact that the sleeve 26 may slide somewhat, due to the cylindrical bearing 28, in the vertical direction along the crushing shaft 24. The combined rotation and swinging of the cylindrical sleeve 26 with unbalance weight 30 mounted thereon causes an inclination of the crushing shaft 24, and makes the crushing shaft 24 gyrate, such that material is crushed between the outer and inner crushing shells 12, 18 forming between them the crushing chamber 23.

In operation of the crusher 1, material is crushed in the crushing chamber 23, between the inner gyrating crushing shell 18 and the outer immovable crushing shell 12. Crushed material falls by gravity from the crushing chamber 23, through the discharge opening 21, down to a discharge zone 36 arranged for forwarding the crushed material from the crushing chamber 23 and out of the crusher 1. The discharge zone 36 is situated below the crushing chamber 23 and surrounds the working part zone 25 of the crusher 1. The working part zone 25 holds for instance the bearings 20, 28 that make it possible for the crushing head 16, and hence the inner crushing shell 18, to perform a gyratory movement relative to the frame 2, and, hence, relative to the outer crushing shell 12. The working part zone 25 also encloses and collects lubricant, such as oil, that is supplied to the bearings 20, 28 for lubrication and cooling thereof. Access of dust or grit to the working part zone 25 might tend to burn out the bearings or reduce their life in other manners, contaminate the lubricant, and/or penetrate to other parts of the transmission of the crusher 1. The working part zone 25 is separated from the discharge zone 36 by the inner cylindrical portion 22 of the crusher frame 6 and by a sealing arrangement 37 including a circumferential flexible sealing member 38 arranged at the upper part of the inner cylindrical portion 22 and a sealing surface 40 arranged on the lower part of the crushing head 16. The sealing member 38 seals against the sealing surface 40. The sealing surface 40 basically includes the exterior surface of a circumferential flange, located on the lower portion, at the periphery, of the crushing head 16. The sealing surface 40 slopes downwardly, as seen in a direction from the discharge zone 36 towards the working part zone 25. The sealing surface 40 has a bulging shape, which may, preferably, have the shape of a spherical segment. The radius of such a spherical segment, i.e., the radius of the sealing surface 40, may, preferably, have the same center as the radius of the spherical bearing 20. The sealing member 38 and the sealing surface 40 are described in connection with FIG. 2*a* and FIG. 2*b* below. The periphery of the lower part of the crushing head 16 has an additional protective skirt 41. To further improve the sealing capacity of the sealing member 38, a duct 42 is arranged for supplying pressurized fluid, such as compressed air, to an overpressure zone 44 at the sealing member 38. The duct 42 is embedded in the wall of the inner cylindrical portion 22. It will be appreciated that the duct 42 could be arranged in other manners, such as partly inside working part zone 25, and that more than one duct could be used.

Figure 2A:
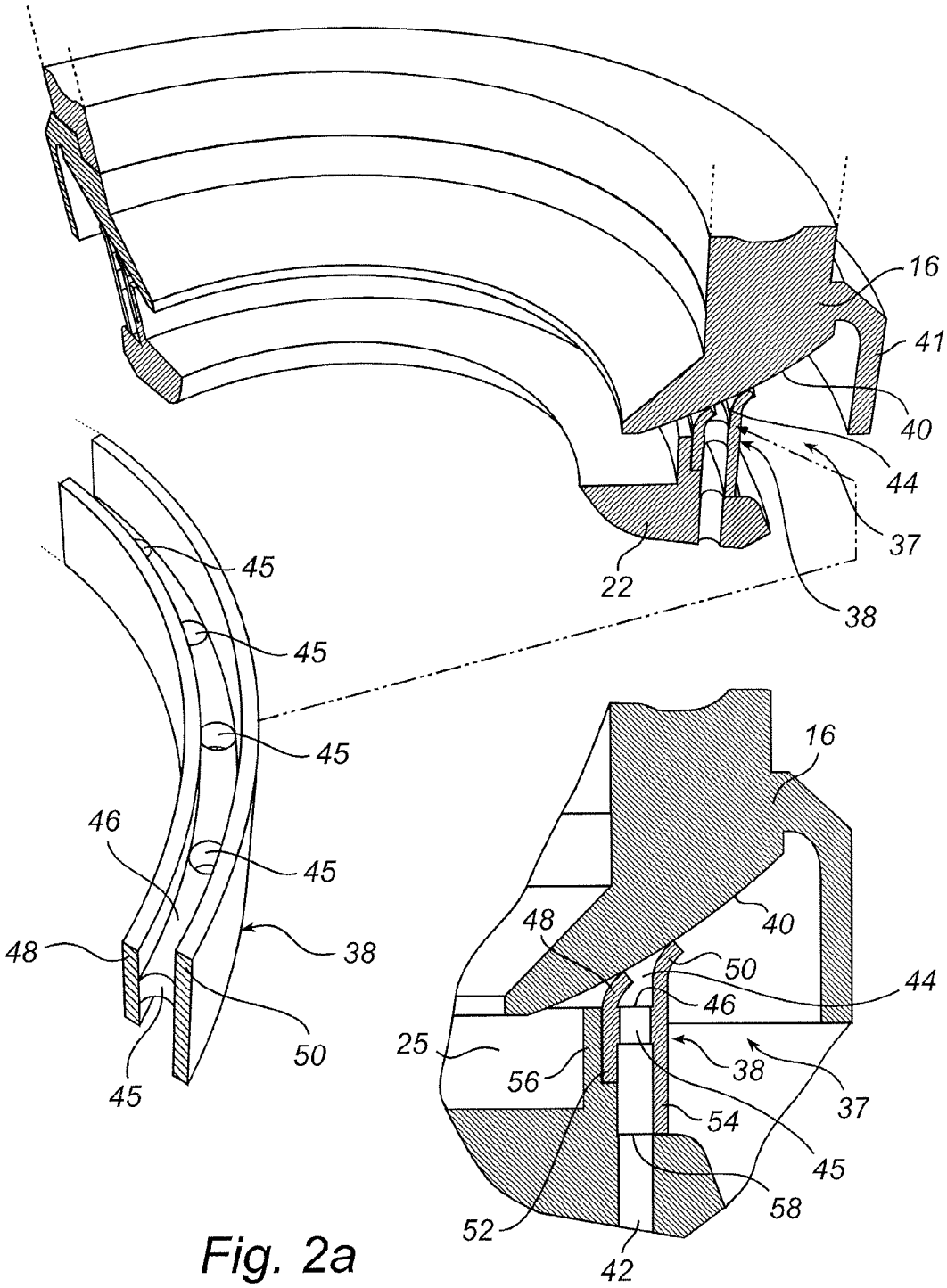
FIG. 2*a* is a schematic illustration showing three different views of parts of the gyratory crusher illustrated in FIG. 1.

In FIG. 2*a* the sealing arrangement 37 of the crusher 1 as described in connection to FIG. 1 is shown in three different views. The upper view in FIG. 2*a* shows a portion of the sealing member 38 of the sealing arrangement 37 in a perspective view, partly in cross section. The middle view in FIG. 2*a* shows the sealing member 38 as seen from above, and before being installed in the crusher. The lower view in FIG. 2*a* shows the sealing member 38 and the sealing surface 40, in cross section, in a side view. In FIG. 2*a* the sealing member 38 is shown in an inactive state, i.e. when pressurized air is not supplied to the overpressure zone 44.

The sealing member 38 is circumferential and extends around the crushing shaft 24 illustrated in FIG. 1, outside of the spherical bearing 20, however the upper view in FIG. 2*a* shows only about a quarter of the whole sealing member 38. The sealing member 38 is in sealing contact with the sealing surface 40 of the lower portion of the crushing head 16. The sealing member 38 is attached to the inner cylindrical portion 22 of the crusher 1, which is immovable. The sealing surface 40 however, onto which the upper part of the sealing member 38 is in sealing contact, gyrates along with the gyrating motion of the crushing head 16 when the crusher 1 is in operation. Therefore, the sealing member 38 slides along the sealing surface 40 eccentrically as the crushing head 16 gyrates.

The middle view in FIG. 2*a* shows one portion of the sealing member 38, when it is not attached to the crusher 1, as seen from above. The sealing member 38 has perforations 45 evenly distributed along a perforated member 46 in the middle portion of the sealing member 38. The perforations 45 are circular shaped with a diameter slightly smaller than the width of the perforated member 46. It will be appreciated that other shapes and sizes of the perforations 45 could also be utilized. As can be seen from the middle view of FIG. 2*a*, the sealing lips 48, 50 are, in this un-installed state, substantially straight and extend vertically upwards from the perforated member 46.

When seen in cross section, which is best viewed in the lower view of FIG. 2*a*, the sealing member 38 is essentially H-shaped. The two upper shanks of the H-shape are formed by an inner circumferential flexible sealing lip 48, and an outer circumferential flexible sealing lip 50. By "flexible" is meant, when used in conjunction with the sealing lips 48, 50, that the material properties of the sealing lips 48, 50 are such that when the sealing lips are pressed against the sealing surface 40 the sealing lips 48, 50 are bent and/or compressed by the sealing surface 40 to provide a tight seal. Furthermore, the degree of flexibility of the outer sealing lip 50 can be adapted to make the outer sealing lip 50 being bent away from the sealing surface 40 when a desired pressure has been built up inside the overpressure zone 44.

The perforated member 46 forms the center of the H-shaped sealing member 38. The two lower shanks of the H-shape are formed by two supports 52, 54. The perforated member 46 holds the sealing lips 48, 50. The inner support 52 is attached to a frame portion 56 of the crusher 1. The inner sealing lip 48 is shorter than the outer sealing lip 50. By "shorter" as used in conjunction with the relation between the inner and outer lips 48, 50 is here meant that the height of the lip, from the portion of the sealing member 38 arranged on the crusher frame portion 56 to the tip of the lip, is lower for the inner lip 48 than for the outer lip 50.

An inlet 58 for compressed air from the duct 42 is located between the supports 52, 54. The perforated member 46, and the supports 52, 54 could be fixed to the crusher 1 by means of, for example, bolting, gluing or clamping. The inner and outer sealing lips 48, 50 may be made of the same material, or may be made of different materials. Typically, the sealing lips would be made of organic polymeric materials, such as plastic and rubber materials. Both the inner sealing lip 48 and the outer sealing lip 50 are flexible. However, the inner sealing lip 48 is pressed towards the sealing surface 40 by the pressurized air and the outer sealing lip 50 is pressed away from the sealing surface 40 by the pressurized air. Thus, it may be preferred to have the inner sealing lip 48 slightly stiffer and/or more wear resistant than the outer sealing lip 50. Such a difference in stiffness and/or wear resistance between the inner and outer lips 48, 50 could be obtained by utilizing different material thicknesses, different types of material, different lengths of the lips 48, 50 etc. The inner sealing lip 48 may for instance be made of polyurethane rubber and the outer sealing lip 50 may be made of natural rubber.

At their upper portions, the sealing lips 48, 50 are in sealing contact with the sealing surface 40. The sealing lips 48, 50 are bent outwards, i.e. away from the central axis C of the crusher 1 and hence away from the working part zone 25, by the sealing surface 40. Since the sealing lips 48, 50 are flexible and the upper portions of the sealing lips 48, 50 are bent by the sealing surface 40, the upper portions of the sealing lips 48, 50 are bent to a shape which resembles a radius of curvature, the radius of which may typically be 20-500 mm. In use of the crusher, the inner sealing lip 48 is in contact with the sealing surface 40 during the entire operation of the crusher. It is important that the inner sealing lip 48 is long enough to provide a tight seal against the sealing surface 40. However, the inner sealing lip 48 should preferably not be bent to such an extent as to interfere with the outer sealing lip 50. The length and the flexibility of the outer sealing lip 50, however, should be adapted to allow the outer sealing lip 50 to be forced away from the sealing surface 40 by the overpressure in the overpressure zone 44. Moreover, the radius of curvature of the lips 48, 50, in their bent condition, is implicitly affected by the pressure acting on the lips 48, 50.

Figure 2B:
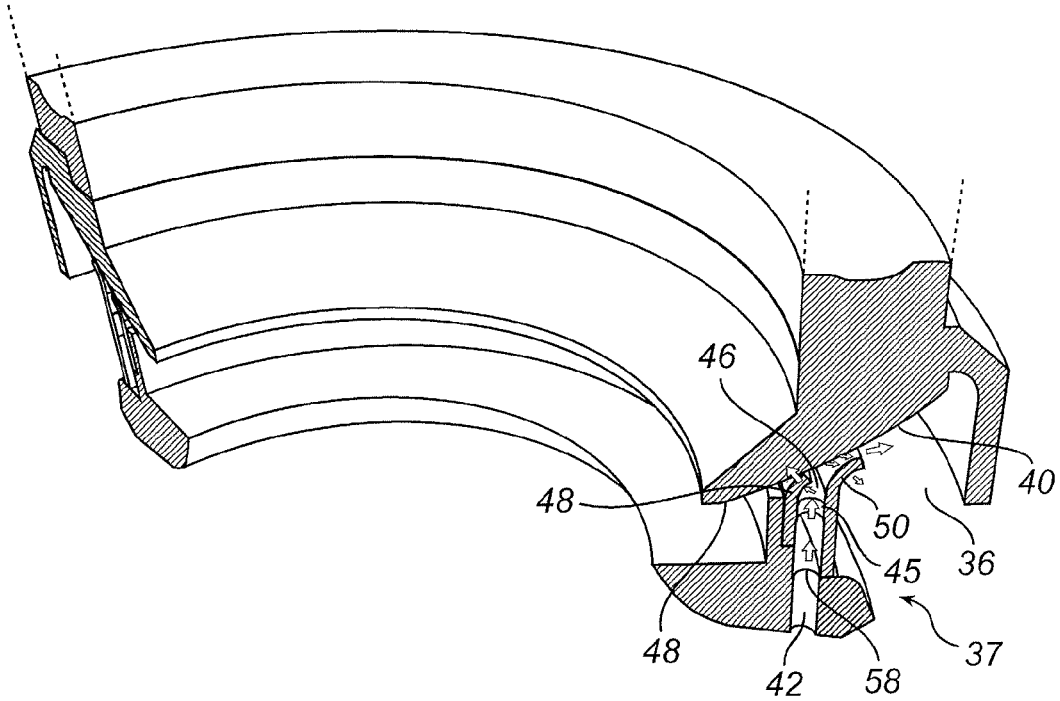
FIG. 2*b* is a schematic illustration showing two views illustrating the function of a sealing arrangement of the crusher of FIG. 1.
Figure 2B:
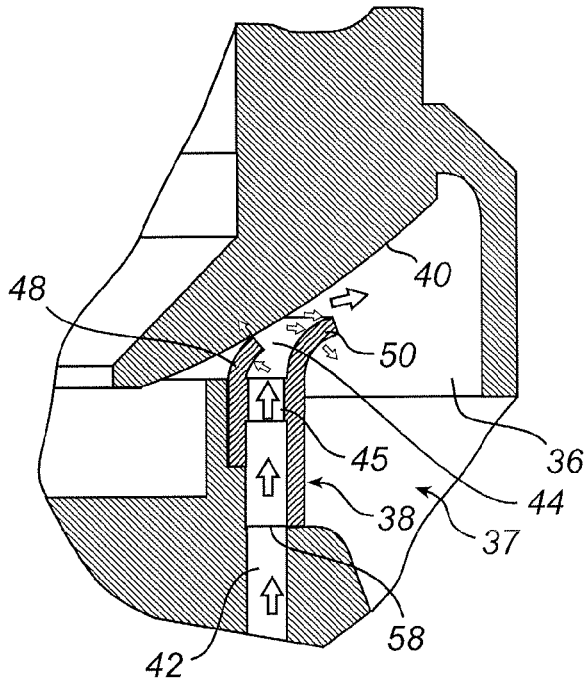

FIG. 2*b* shows a similar view and the same components as FIG. 2*a* but the middle view is omitted. In FIG. 2*b*, compressed air is supplied via the duct 42, as illustrated with arrows in FIG. 2*b*. The compressed air flows through the inlet 58, passes through the perforations 45 in the perforated member 46, and enters the overpressure zone 44 being defined by the sealing lips 48, 50, the perforated member 46 and the sealing surface 40. Thus, an overpressure is created in the overpressure zone 44 and the flexible sealing lips 48, 50 are forced away from each other, which is illustrated with the arrows in FIG. 2*b*. The outer sealing lip 50, i.e. the sealing lip which is closest to the discharge zone 36, is pushed slightly away from the sealing surface 40 and the compressed air is allowed to pass out from the overpressure zone 44 into the discharge zone 36. Dust and particles in the discharge zone 36 are consequently blown away from the area around the outer sealing lip 50.

Since the inner sealing lip 48 is bent outwards by the sealing surface 40, the overpressure created in the overpressure zone 44 forces the inner sealing lip 48 towards the sealing surface 40. Thus, the overpressure in the overpressure zone 44 will increase that force by means of which the inner sealing lip 48 is forced against the sealing surface 40, and consequently the sealing effect of the inner sealing lip 48 will be improved. In other words, the overpressure created in the overpressure zone 44 will force the inner sealing lip 48 to a tighter seal against the sealing surface 40, thereby providing for an increased sealing effect between inner lip 48 and sealing surface 40 that is efficient for preventing any material from entering working part zone 25. The outer sealing lip 50 is pushed slightly away from the sealing surface 40 which allows the air in overpressure zone 44 to be blown out in the discharge zone 36, and away from the working part zone 25, thereby blowing away dust in a direction away from working part zone 25.

As mentioned hereinbefore, the degree of flexibility of the outer sealing lip 50 can be adapted to make the outer sealing lip 50 being bent away from the sealing surface 40 when a desired pressure has been built up inside the overpressure zone 44, such pressure being suitable for obtaining a sufficient sealing force between inner sealing lip 48 and sealing surface 40, and for obtaining a suitable flow and flow velocity of compressed air leaving the gap formed between outer sealing lip 50 and sealing surface 40.

Figure 3A:
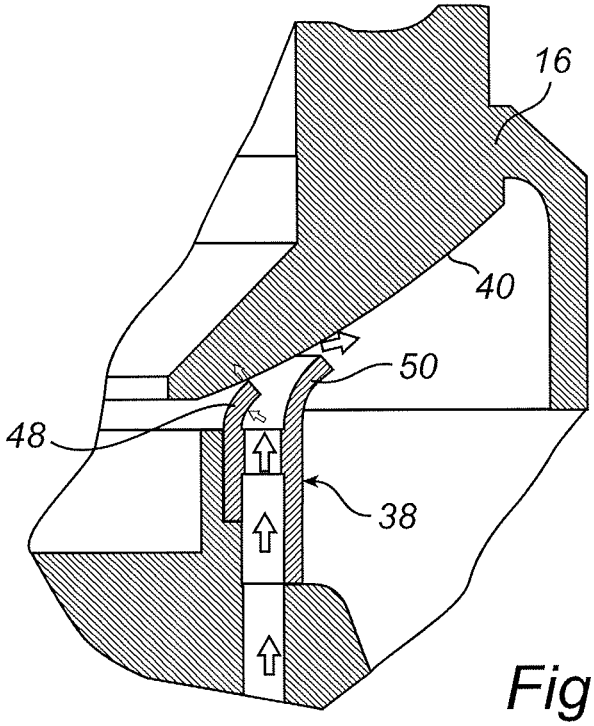
FIGS. 3*a-b* are schematic illustrations showing the function of the sealing arrangement of the crusher of FIG. 1.
Figure 3B:
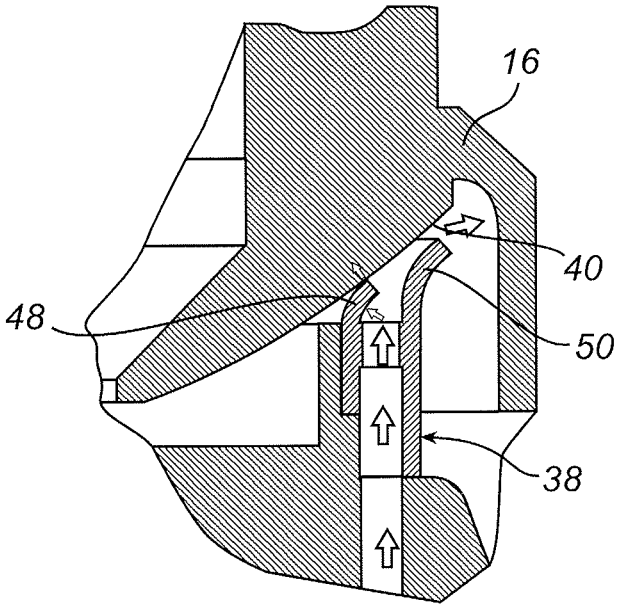

Each of FIG. 3*a* and FIG. 3*b* show a similar view and the same components as the lower view of FIG. 2*b*. FIGS. 3*a* and 3*b* illustrate that the sealing surface 40, in addition to rotating relative to the sealing member 38, also moves laterally with respect to the sealing member 38 during operation of the crusher. This is due to the fact that the sealing surface 40 gyrates along with the gyrating motion of the crushing head 16. Therefore, a relative movement between the sealing member 38, which is arranged in connection to the crusher frame, and the sealing surface 40 occurs during the operation of the crusher. FIGS. 3*a* and 3*b* illustrate the respective extremes of the lateral movement of the sealing surface 40 in relation to the sealing member 38. As described hereinbefore the sealing surface 40 has a spherical shape and bulges towards sealing member 38. Owing to this fact, the sealing lips 48, 50 of sealing member 38 will, as illustrated in FIGS. 3*a* and 3*b*, have substantially the same degree of bending in both extremes of the lateral movement, and also in the intermediate position of lateral movement, best illustrated in the lower view of FIG. 2*b*.

While the invention has been disclosed with reference to certain preferred embodiments, numerous modifications, alterations, and changes to the described embodiments are possible without departing from the sphere and scope of the invention, as defined in the appended claims and their equivalents thereof. For example, the shape of the sealing member 38 may be different from the H-shape disclosed above. A U-shaped sealing member without the supports 52, 54 is another example of a sealing member shape. It is also possible to have other distribution means for the supplied compressed air than the evenly repeated perforations 45 disclosed above. It may be suitable to have larger or smaller perforations, or to supply more air to some portions of the overpressure zone. It may also be suitable to have more than one inlet for the pressurized fluid.

Moreover, the shape and arrangement of the sealing surface 40 may vary. In the above disclosed embodiments the sealing surface 40 is a lower portion of the crushing head which is formed as a circumferential flange. The sealing lips 48, 50 may seal directly on the main body of the crushing head 16 or on any other suitable arrangement on the crusher 1.

Hereinbefore it has been described that the sealing lips 48 and 50 are flexible and as such are bent by the sealing surface 40. It will be appreciated that bending is not the only way in which the sealing lips 48, 50 may conform to the sealing surface 40. In addition, or as alternative to, being bent the sealing lips 48, 50 may also be compressed, i.e., the sealing lips 48, 50 may be compressed to a shorter length and/or to a smaller thickness, by the sealing surface 40.

In the embodiments illustrated hereinbefore, the sealing surface 40 is arranged on the crushing head 16, and the sealing member 38 is arranged on an immovable part of the crusher frame 2. It will be appreciated that it is also possible, as an alternative, to arrange a sealing member on the crushing head, and the sealing surface on an immovable part of the crusher frame 2.

Hereinbefore it has been described that the sealing surface 40 may have the shape of a spherical segment, as illustrated in for example FIG. 2*a*. It will be appreciated that the sealing surface 40 may, alternatively, have another shape, which is also a bulging shape, bulging towards the flexible sealing member 38, but which does not conform to the form of a spherical shape. Furthermore, the sealing surface could also have a straight shape, not bulging towards the flexible sealing member 38. Such a straight shape would preferably have an angle of 15° to 75° to the horizontal plane.

Hereinbefore, the sealing arrangement 37 has been illustrated with reference to a gyratory crusher of the so-called inertia cone crusher type, an example of which is illustrated in RU 2 174 445. It will be appreciated that the sealing arrangement 37 can be used also for other types of gyratory crushers, for example gyratory crushers having a fixed eccentric for obtaining the gyratory movement, and having a mechanical or hydraulic adjustment of the outer shell, such crusher types being disclosed in, for example, U.S. Pat. No. 1,791,584 and U.S. Pat. No. 4,793,560, respectively.

Hereinbefore it has been described that perforated member 46 holds the sealing lips 48, 50 and has perforations through which a pressurized fluid can be supplied. It will be appreciated that other embodiments are also possible. For example, alternative spacers, such as rectangular parallelepiped shaped spacers, could be utilized to form a distance between inner and outer sealing lips 48, 50, and openings between such spacers for supplying pressurized fluid. It would also be possible to supply pressurized fluid to the overpressure zone 44 via an opening in one of the sealing lips, as alternative to supplying pressurized fluid via perforations 45.

Hereinbefore it has been described, with reference to FIG. 2*a* that flexible sealing member 38 is a complete unit including perforated member 46 and sealing lips 48, 50. It will be appreciated that it is also possible to mount the sealing lips 48, 50, and optionally the perforated member 46, as loose pieces one by one directly on the crusher 1.

Accordingly, it is intended that the invention not be limited to the described embodiments, but that it have the full scope defined by the language of the following claims.

What is claimed is:

1. A gyratory crusher, comprising:

an outer crushing shell and an inner crushing shell forming between them a crushing chamber, the crushing chamber communicating with a discharge zone that forwards crushed material from the crushing chamber and out of the crusher;

the inner crushing shell being supported on a crushing head;

the outer crushing shell being supported on a crusher frame;

at least one sealing arrangement between the discharge zone and a working part zone in which at least one bearing for the crushing head to perform a gyratory movement relative to the crusher frame is arranged, wherein the sealing arrangement includes a sealing surface, and a sealing member arranged to seal against the sealing surface and including an inner circumferential flexible sealing lip, an outer circumferential flexible sealing lip and at least one inlet for pressurized fluid to be supplied to an overpressure zone arranged between the inner and outer sealing lips and the sealing surface, one of the sealing member and the sealing surface being arranged in connection to the crushing head, and the other of the sealing member and the sealing surface being arranged in connection to the crusher frame.

2. The gyratory crusher according to claim 1, wherein at least one of the sealing lips is bent outwardly by the sealing surface.

3. The gyratory crusher according to claim 1, wherein the inner and outer sealing lips are both bent outwardly by the sealing surface.

4. The gyratory crusher according to claim 1, wherein the sealing surface slopes downwardly, as seen in a direction from the discharge zone towards the working part zone.

5. The gyratory crusher according to claim 1, wherein the inner sealing lip is shorter than the outer sealing lip.

6. The gyratory crusher according to claim 1, wherein the sealing surface is arranged in connection to the crushing head.

7. The gyratory crusher according to claim 1, wherein the sealing member comprises a perforated member which holds the sealing lips and allows passage of pressurized fluid from the inlet to the overpressure zone.

8. A method of shielding a working part zone of a gyratory crusher, the gyratory crusher including an outer crushing shell and an inner crushing shell forming between them a crushing chamber, the crushing chamber communicating with a discharge zone being that forwards crushed material from the crushing chamber and out of the crusher, the inner crushing shell being supported on a crushing head, and the outer crushing shell being supported on a crusher frame, at least one sealing arrangement including a sealing member and a sealing surface and being situated between the discharge zone and the working part zone in which at least one bearing for the crushing head to perform a gyratory movement relative to the crusher frame is arranged, the method comprising:

supplying pressurized fluid to an overpressure zone located between an inner circumferential flexible sealing lip and an outer circumferential flexible sealing lip of the sealing member to make the sealing member seal against the sealing surface, one of the sealing member and the sealing surface being arranged in connection to the crushing head, and the other of the sealing member and the sealing surface being arranged in connection to the crusher frame.

9. The method of shielding a working part zone of a gyratory crusher according to claim 8, wherein at least one of the sealing lips is bent outwardly by the sealing surface.

10. The method of shielding a working part zone of a gyratory crusher according to claim 8, wherein the pressurized fluid supplied to the overpressure zone forces the outer sealing lip away from the sealing surface.

11. The method of shielding a working part zone of a gyratory crusher according to claim 8, wherein the pressurized fluid supplied to the overpressure zone forces the inner sealing lip against the sealing surface.

12. The method of shielding a working part zone of a gyratory crusher according to claim 8, wherein the pressurized fluid is compressed air.

13. The gyratory crusher according to claim 1, wherein the pressurized fluid supplied to the overpressure zone forces the outer sealing lip away from the sealing surface, and the pressurized fluid supplied to the overpressure zone forces the inner sealing lip against the sealing surface.

14. The gyratory crusher according to claim 1, wherein the inner sealing lip is stiffer and/or more wear resistant than the outer sealing lip.

15. The gyratory crusher according to claim 1, wherein the inner and outer sealing lips are both bent outwardly from a central axis of the crusher.

16. The method of shielding a working part zone of a gyratory crusher according to claim 8, wherein the pressurized fluid supplied to the overpressure zone forces the outer sealing lip away from the sealing surface, and the pressurized fluid supplied to the overpressure zone forces the inner sealing lip against the sealing surface.

17. The method of shielding a working part zone of a gyratory crusher according to claim 8, wherein the inner sealing lip is stiffer and/or more wear resistant than the outer sealing lip.

18. The method of shielding a working part zone of a gyratory crusher according to claim 8, wherein the inner and outer sealing lips are both bent outwardly from a central axis of the crusher.

* * * * *